US009790960B2

(12) United States Patent
Postuchow

(10) Patent No.: US 9,790,960 B2
(45) Date of Patent: Oct. 17, 2017

(54) CENTRIFUGAL PUMP WITH GOVERNOR ACTUATED SEAL

(71) Applicant: A.R. Wilfley and Sons, Inc., Denver, CO (US)

(72) Inventor: Jack Postuchow, Houston, TX (US)

(73) Assignee: A.R. WILFLEY & SONS, INC., Commerce City, CO (US)

( * ) Notice: Subject to any disclaimer, the term of this patent is extended or adjusted under 35 U.S.C. 154(b) by 625 days.

(21) Appl. No.: 14/299,994

(22) Filed: Jun. 9, 2014

(65) Prior Publication Data

US 2015/0354583 A1 Dec. 10, 2015

(51) Int. Cl.
*F04D 29/62* (2006.01)
*F04D 29/14* (2006.01)

(52) U.S. Cl.
CPC ..... *F04D 29/628* (2013.01); *F04D 29/146* (2013.01); *Y10T 29/49298* (2015.01)

(58) Field of Classification Search
CPC ..... F04D 29/628; F04D 29/146; F04D 29/12; F04D 29/10; F04D 29/08; F04D 29/60
USPC ..... 277/25, 41
See application file for complete search history.

(56) References Cited

U.S. PATENT DOCUMENTS 3,652,180 A 3/1972 Choquette et al.
4,497,493 A * 2/1985 Sall ..... F16J 15/3404 277/306
4,639,000 A * 1/1987 Warner ..... F16J 15/3468 277/373
4,915,579 A 4/1990 Whittier et al.
4,932,837 A * 6/1990 Rymal ..... F04D 29/4286 415/169.1
5,261,786 A 11/1993 Sidelko
5,580,215 A 12/1996 Sidelko et al.
(Continued)

FOREIGN PATENT DOCUMENTS

CN 2421436 Y * 2/2001 ..... F04D 29/04
GB 2078877 1/1982
(Continued)

OTHER PUBLICATIONS

Translation provided by Google Patents for CN 2421436 Y (Feb. 28, 2001).*
(Continued)

*Primary Examiner* — Gregory Anderson
*Assistant Examiner* — Jason Davis
(74) *Attorney, Agent, or Firm* — Sheridan Ross P.C.

(57) ABSTRACT

The present invention relates to centrifugal pumps, and more specifically to a centrifugal pump device with a governor actuated cartridge seal and a method of attaching a centrifugal pump device with a governor actuated cartridge seal. The centrifugal pump comprises a sealing system that prevents undesirable fluid leaking or air ingestion when in operation while allowing ease of installation and maintenance. The governor actuated cartridge seal automatically increases sealing capabilities by urging a movable seal as a function of impeller or engine drive shaft rotational speed. The governors actuate radially so as to present a minimal profile and therefore not introduce a safety hazard. Scalable weights attached to the governors allow predictable calibration and initialization of the pump under varying hydraulic pressures and rotational speeds.

22 Claims, 12 Drawing Sheets

(56) References Cited

U.S. PATENT DOCUMENTS

| | | | | |
|---|---|---|---|---|
| 5,667,356 | A | 9/1997 | Whittier et al. | |
| 6,024,362 | A | 2/2000 | Fedorovich | |
| 6,076,830 | A | 6/2000 | Wu et al. | |
| 6,116,610 | A | 9/2000 | Goldswain et al. | |
| 6,224,322 | B1 | 5/2001 | Calboreanu | |
| 6,485,024 | B1 | 11/2002 | Pippert et al. | |
| 6,517,078 | B2 | 2/2003 | Schuefer et al. | |
| 6,616,145 | B2 | 9/2003 | Schulten et al. | |
| 6,685,191 | B2 | 2/2004 | Toal | |
| 7,044,471 | B2 * | 5/2006 | Elliott | F04D 29/126 277/412 |
| 7,280,219 | B1 * | 10/2007 | Discenzo | B60C 23/0408 356/477 |
| 7,878,509 | B2 | 2/2011 | Takahashi | |
| 8,191,899 | B2 | 6/2012 | Droscher et al. | |
| 8,220,801 | B2 | 7/2012 | Allegretti et al. | |
| 8,240,673 | B2 | 8/2012 | Manninen | |
| 8,328,202 | B2 | 12/2012 | Foster et al. | |
| 2002/0140177 | A1 * | 10/2002 | Murray | F04D 29/108 277/500 |
| 2007/0241511 | A1 * | 10/2007 | Kim | F16J 15/363 277/358 |
| 2008/0019831 | A1 * | 1/2008 | Kajiwara | F04D 7/06 415/214.1 |
| 2009/0108540 | A1 * | 4/2009 | Kolb, Jr. | F04D 17/168 277/562 |
| 2012/0025473 | A1 | 2/2012 | Takahashi | |
| 2012/0139186 | A1 | 6/2012 | Suefuji | |
| 2013/0011256 | A1 | 1/2013 | Holzapfel et al. | |
| 2014/0271177 | A1 * | 9/2014 | Kosmicki | F04D 29/4286 415/230 |

FOREIGN PATENT DOCUMENTS

| | | |
|---|---|---|
| JP | 2005-249131 | 9/2005 |
| WO | WO 2004/029489 | 4/2004 |
| WO | WO 2013/026526 | 2/2013 |
| WO | WO 2013/047658 | 4/2013 |
| WO | WO 2013/068066 | 5/2013 |

OTHER PUBLICATIONS

"Stationary Cartridge seals. How to solve the problem of seal movement 11-10," retrieved from http://www.mcnallyinstitute.com/11-html/11-10.html, retrieved on Jun. 7, 2013, 5 pages.

"File:Centrifugal Pump.png," Wikipedia, 2008, retrieved from https://en.wikipedia.org/wiki/File:Centrifugal_Pump.png, retrieved on Dec. 9, 2013, 2 pages.

"Cartex® Seals," brochure, EagleBurgmann, 2010, 4 pages.

* cited by examiner

CENTRIFUGAL PUMP WITH GOVERNOR ACTUATED SEAL

FIELD OF THE INVENTION

The disclosure relates to pump seals, and more specifically to governor actuated seals for use with centrifugal pumps, and a method of and apparatus for adjusting cartridge seals to pumps.

BACKGROUND OF THE INVENTION

Centrifugal pumps transport fluid by converting input rotational energy to hydrodynamic energy. The energy conversion is provided by an impeller driven by an engine. Fluid enters the impeller inlet along an axis parallel to the pump's drive shaft. The disc-like impeller reduces liquid pressure at the eye which draws in more fluid and centrifugally accelerates the fluid into a radial pump outlet. Centrifugal pumps are commonly used to transport fluids containing solid particles, referred to as "slurries."

Because of the naturally high dynamic loading and hydraulic pressures inherent in centrifugal pumps, and attendant maintenance and installation requirements, a variety of seals are employed. The variety of seals attempt to balance the need to prevent undesirable fluid leaking or air ingestion during pumping operations while allowing ease of installation and maintenance. Ideally, the configuration of seals allows predictable containment and control of the fluid within the pump under varying hydraulic pressures and rotational speeds. In addressing the above engineering and operational requirements, centrifugal pumps may include a dynamically-actuated seal to automatically engage or increase sealing capabilities as a function of impeller or drive shaft rotational speed. It is desirable that any dynamically-actuated pump sealing elements require minimal lengthening of the drive shaft and are easily and predictably installed.

One example of a centrifugal pump fitted with a dynamically-actuated seal is disclosed in U.S. Pat. No. 5,667,356 to Whittier et al ("Whittier"), incorporated herein by reference in its entirety. The centrifugal pump incorporates a ball bearing assembly as a force-responsive governor to control opening and closing of a fluid path leading from an expeller region into a seal. The seals are composed of hard, low-friction sealing materials for handling acids and of resilient materials for handling slurries owing to the solids content in the slurries. The force-responsive governor of Whittier is limited in its operational range once installed due to the self-confined design that requires disassembly to adjust the number of governor balls. Also, Whittier's seals do not lend to predictable containment and control of the fluid of the pump due to lack of adjustment for compounded tolerances.

Another example of a centrifugal pump fitted with a dynamically-actuated seal is disclosed in U.K. Patent Application No. GB 2,078,877 to Waters ("Waters"), incorporated herein by reference in its entirety. The centrifugal pump of Waters has a drive shaft rotating a pumping impeller and an axially adjacent impeller providing a dynamic seal for a pump chamber. A partition separates the dynamic seal from a static seal comprising a carbon ring on a carrier on the shaft spring pressed against a stationary ring secured to the partition. As illustrated in FIG. 1 of Waters, the carrier is axially moved by centrifugally acting arms (58) to withdraw the sealing ring when a predetermined shaft speed is exceeded. The force-responsive seal of Waters, as provided by the centrifugally acting arms, present an unnecessarily large footprint due to an extended axial length of the shaft to accommodate the axially aligned arms. Lengthening a drive shaft is more costly, creates a heavier shaft requiring more robust bearings adding further expense, and increases vibration and noise. In addition, the orientation of the arms parallel to the shaft create a hazard for operators working in the vicinity of the arms during operation. A hand, arm or tool placed in the path of the rotating arms would likely be damaged and could also cause damage to the pump. Furthermore, Waters' seals do not provide predictable calibration and initialization of the pump under varying hydraulic pressures and rotational speeds.

A further issue with cartridge seals generally is the use of removable pre-load tabs. FIG. 1 is an illustration of one example of pre-load tabs applied to a cartridge seal. As shown, the tabs secure the shaft sleeve to the cartridge housing and apply a pre-load to the seal. Once the cartridge seal is installed, the tabs must be removed for the pump to operate as the shaft sleeve must be free to rotate with the pump shaft. However, the tabs must be reinstalled for maintenance and adjustment of the cartridge seal. Therefore, the tabs must be saved and stored in a known and reliable location for use during future maintenance. As can be appreciated, the tabs are often misplaced, lost or even thrown away.

There is a need for a pump fitted with a sealing system that prevents undesirable fluid leaking or air ingestion. There is a need to provide a centrifugal pump with a dynamically-actuated seal that automatically increases sealing capabilities as a function of impeller or engine drive shaft rotational speed. There is a further need to provide a dynamically actuated seal in a manner that reduces overall seal axial length and that presents a minimal profile when actuated. In addition, there is also a need for a cartridge sealing system for use with pumps that provides ease of installation and maintenance, as wells as predictable containment and control of the fluid within the pump under varying hydraulic pressures and rotational speeds. There is a need for a system and method to apply a preload to a cartridge seal without removable tabs. The present invention meets these needs by providing both an improved governor actuated seal and a cartridge seal that provides a method of and apparatus for attaching a cartridge seal to a pump.

SUMMARY OF THE INVENTION

In one embodiment, the cartridge seal comprises a cylindrical shaft sleeve, a plurality of governors positioned on the exterior of the proximal end of the cylindrical shaft sleeve, and at least one movable seal positioned radially outwardly of the shaft sleeve and axially movable relative to the shaft sleeve by operation of the governors. A housing surrounds the at least one movable seal to form a cartridge. The cylindrical shaft sleeve is adapted to interconnect the cartridge seal to a drive shaft and receive a fluid pressure at the distal end. The governors are configured to extend outwardly with drive shaft rotation. Preferably, the governors extend outwardly within the same plane, where the plane is defined perpendicular to the axis of the shaft. The movable seal has a proximal end which engages with a respective actuator of each governor. The at least one movable seal is positioned distally of each respective governor and is positioned outwardly of the cylindrical shaft sleeve. When the drive shaft is at rest, the at least one movable seal is at a first position and provides a fluid seal with respect to the fluid pressure. When the drive shaft is at a rotational speed, the governors extend radially outwardly to displace the at least one movable seal to a second position distal to the first position to provide an increased fluid seal.

In another aspect of one embodiment, the seal housing is provided in the form of a cartridge that is connected to the drive shaft of a pump by a plurality of set screws. The housing comprises a cylindrical collar surrounding a majority of the cylindrical shaft sleeve and movable seal. Cutouts are formed in the cylindrical shaft sleeve at spaced locations around the circumference to receive the set screws to secure the cylindrical shaft sleeve to the drive shaft. A similar number of spaced apertures are formed in the movable seal and align with the cutouts in the cylindrical shaft sleeve when the two components are properly mated. The collar comprises a radially inward facing channel or groove covering at least a majority of the installed set screws and permits the set screws to rotate with the drive shaft without interference from the collar and without exposure to an operator, thereby also providing a safety feature. The collar does not completely encircle the cylindrical shaft sleeve and movable seal, but comprises an open portion to allow access to the set screws. The set screws replace conventional lock tabs used to apply a preload to a cartridge seal, but which are often lost or misplaced when needed for subsequent maintenance because they must be removed during operation of the pump. Accordingly, a method of and apparatus for attaching the cartridge seal to a pump is also disclosed. The method comprises the steps of: providing a cartridge seal, axially aligning and fitting the cartridge seal with a drive shaft of a pump, securing a mounting plate of the cartridge seal to the pump, accessing individual set screws through the open portion of a collar formed in the housing of the cartridge seal, and advancing the individual set screws to engage the drive shaft and secure the cartridge seal to the drive shaft.

In yet another aspect of one embodiment, each governor has an arcuately-shaped length extending along a circumference of the cylindrical shaft sleeve and a height extending radially from the cylindrical shaft sleeve upon a threshold RPM being achieved. Optionally, each governor may be provided with a plurality of score lines to facilitate cutting the governor and removing a portion of the length of the governor to alter the weight and performance of each governor. Data may be provided that quantifies the operational performance of the pump and seal based upon removing weight from the governors is defined by each score line. In this way, the performance of the cartridge seal may be more closely set to meet actual operating conditions.

The phrase "device" and/or "apparatus" is used herein to indicate embodiments of the invention device. The phrase "automatic" refers to a device's ability to automatically adjust and/or adapt itself to maintain and/or monitor a specified condition or state. The phrase "removably attached" and/or "detachable" is used herein to indicate an attachment of any sort that is releasable. The phrase "fluid" and/or "fluids" means liquids as well as mixtures thereof and mixtures of such with solids. The phrase "slurry" means a fluid containing solid particles. The phrases "radially outward" and "radially inward" mean relative to the axis of the drive shaft. As used herein, the terms "proximal" and "distal" are axial terms, and the terms "inner" and "outer" are radial terms. Proximal and distal refer respectively to relative right and left sides of the cartridge seal. Similarly, references inner and outer refer respectively to radial positions relatively closer and further to the axial centerline.

One of ordinary skill in the art will appreciate that embodiments of the present disclosure may be constructed of materials known to provide, or predictably manufactured to provide the various aspects of the present disclosure. These materials may include, for example, stainless steel, titanium alloy, aluminum alloy, chromium alloy, and other metals or metal alloys. The sealing elements could be semi-rigid or rigid.

This Summary of the Invention is neither intended nor should it be construed as being representative of the full extent and scope of the present disclosure. The present disclosure is set forth in various levels of detail in the Summary of the Invention as well as in the attached drawings and the Detailed Description, and no limitation as to the scope of the present disclosure is intended by either the inclusion or non-inclusion of elements, components, etc. in this Summary of the Invention. Additional aspects of the present disclosure will become more readily apparent from the Detailed Description, particularly when taken together with the drawings.

The above-described benefits, embodiments, and/or characterizations are not necessarily complete or exhaustive, and in particular, as to the patentable subject matter disclosed herein. Other benefits, embodiments, and/or characterizations of the present disclosure are possible utilizing, alone or in combination, as set forth above and/or described in the accompanying figures and/or in the description herein below. However, the Detailed Description of the Invention, the drawing figures, and the exemplary claim set forth herein, taken in conjunction with this Summary of the Invention, define the invention.

BRIEF DESCRIPTION OF THE DRAWINGS

The accompanying drawings, which are incorporated in and constitute a part of the specification, illustrate embodiments of the disclosure and together with the general description of the disclosure given above and the detailed description of the drawings given below, serve to explain the principles of the disclosures.

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

DETAILED DESCRIPTION

Figure 1:
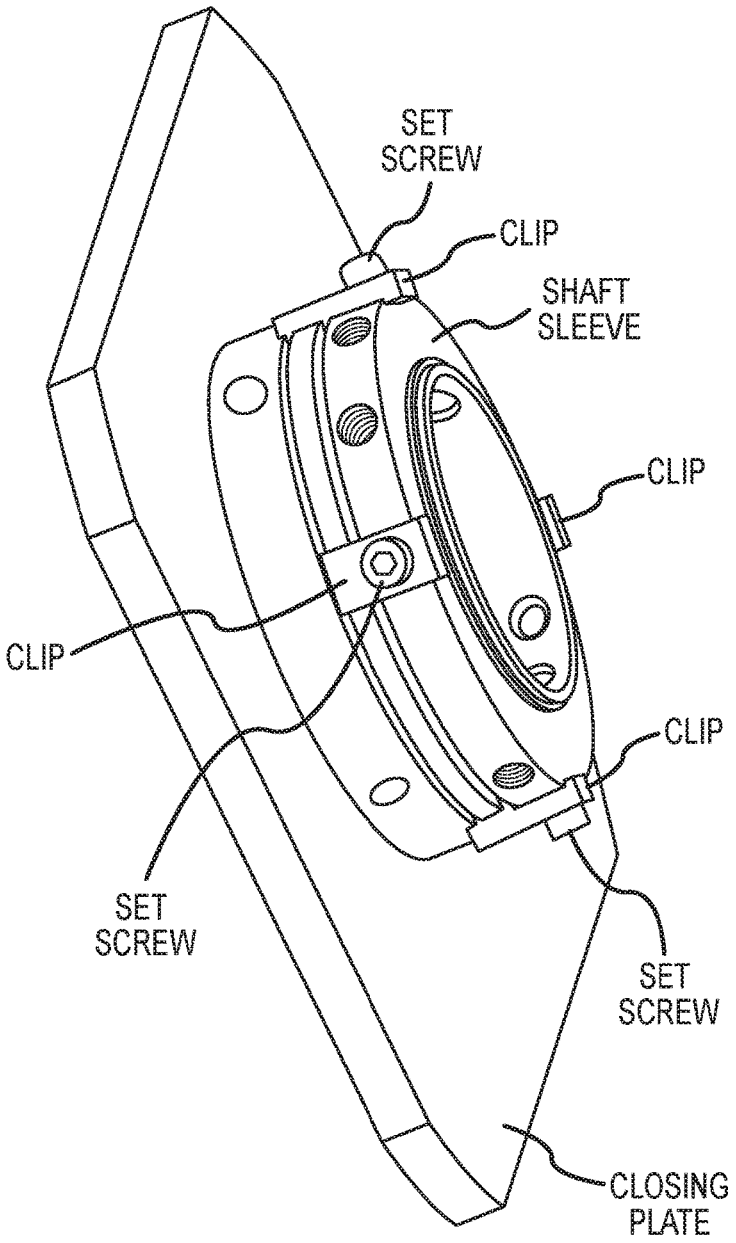
FIG.1 PRIOR ART
FIG. 1 is a perspective view of a prior art cartridge seal, illustrating the use of pre-load tabs.

The following description will typically be with reference to specific structural embodiments and methods. It is to be understood that there is no intention to limit the invention to the specifically disclosed embodiments and methods but that the invention may be practiced using other features, elements, methods and embodiments. Preferred embodiments are described to illustrate the present invention, not to limit its scope, which is defined by the claims. Those of ordinary skill in the art will recognize a variety of equivalent variations on the description that follows. Like elements in various embodiments are commonly referred to with like reference numerals.

Figure 2:
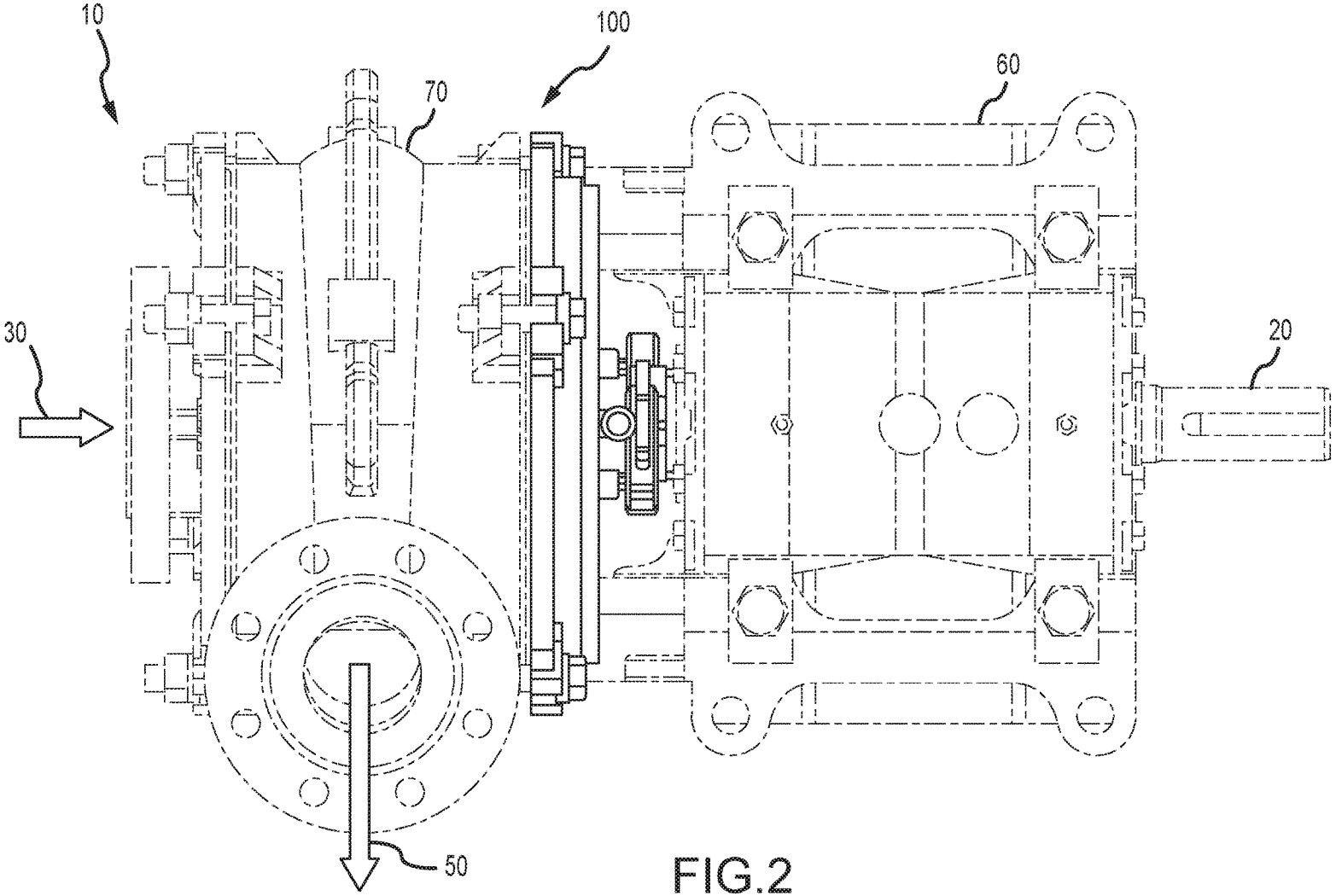
FIG. 2 is a top plan view of a centrifugal pump cartridge seal (shown in solid lines) as a component of a centrifugal pump and bearing assembly (shown in dashed lines) according to one embodiment of the device.
Figure 3:
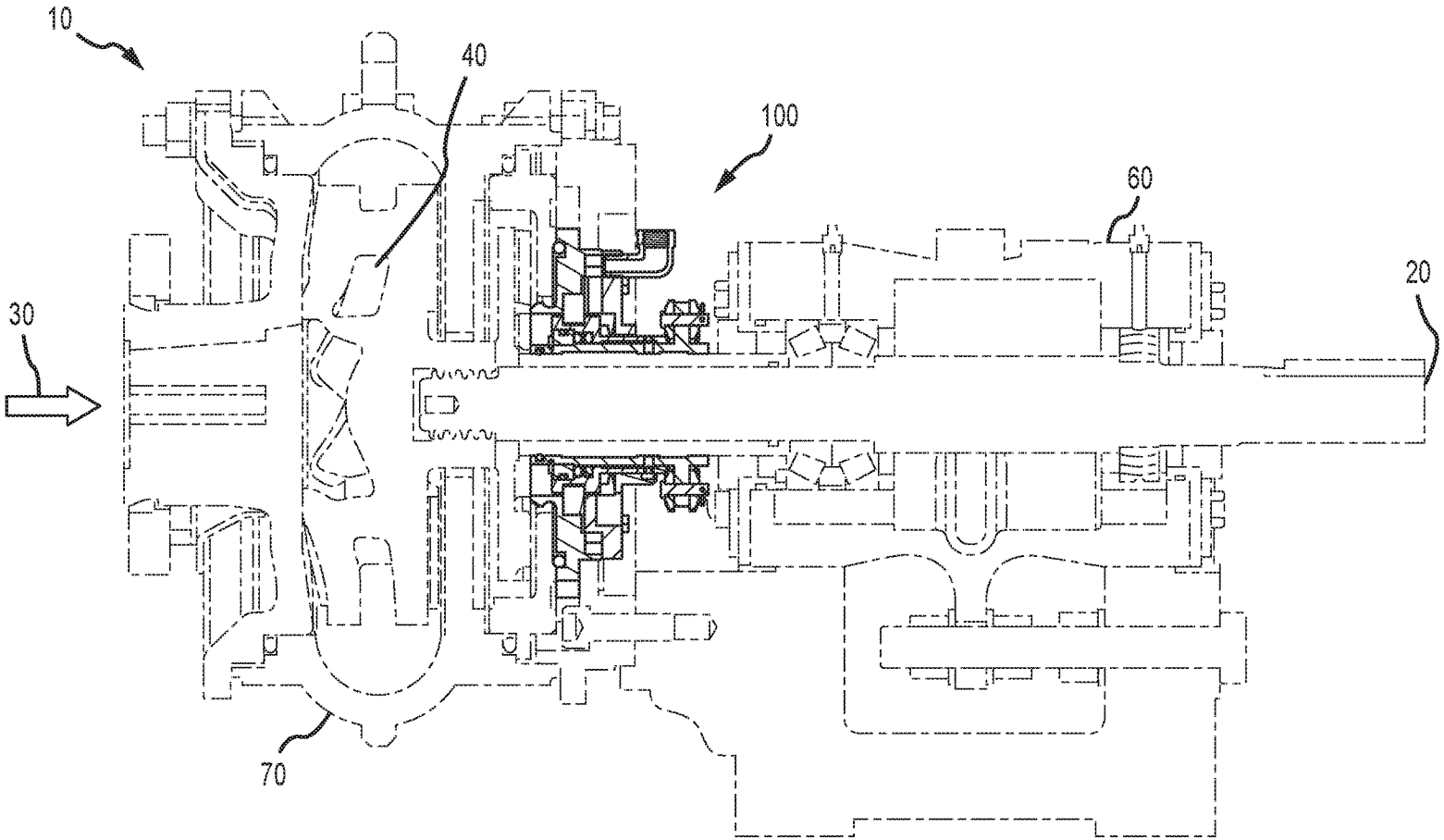
FIG. 3 is a cross-sectional left-side elevation view of the centrifugal pump cartridge seal (shown in solid lines) of FIG. 2 as a component of a centrifugal pump and bearing assembly (shown in dashed lines)

With reference to FIGS. 2 and 3, one embodiment of a cartridge seal 100 as a component of a centrifugal pump 10 is shown. The drive shaft 20 of the centrifugal pump 10 forms an axial centerline. Generally, slurry input 30 enters the distal or wet end of the pump 10 and flows axially toward pump impeller 40 and exits at slurry output 50. Drive shaft 20, supported by bearing assembly 60, powers pump impeller 40. When pump impeller 40 is rotating, a suction is created which urges slurry into input 30 and provides a fluid pressure onto cartridge seal 100. When pump impeller 40 is not rotating and pump 10 is still in fluid communication with slurry at input 30, a fluid (static) pressure is imparted to the cartridge seal 100.

Figure 4:
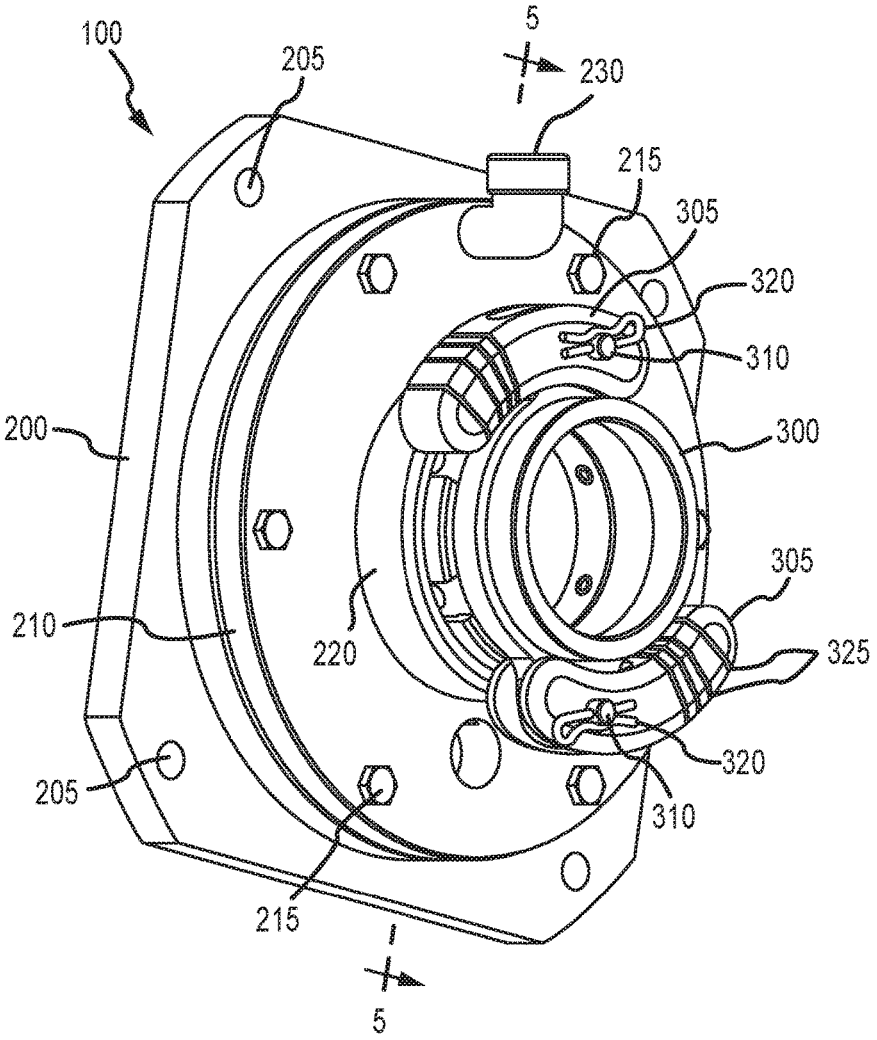
FIG. 4 is a perspective view of the proximal end of the centrifugal pump cartridge seal device of FIG. 2.

FIG. 4 provides a perspective view of the proximal end of one embodiment of the cartridge seal 100. Mounting plate or stuffing box 200 attaches to the pump housing 70 by bolts inserted through apertures 205. Closing plate or cover 210 is affixed to the mounting plate 200 by mounting bolts 215. A collar 220 extends outwardly from the closing plate 210 and circumferentially surrounds the drive shaft 20. Shaft sleeve 300 fits circumferentially around drive shaft 20 and inside the collar 220. As illustrated, two governors 305 are pivotally mounted on pivot pins 310 at the distal end 315 of the shaft sleeve 300. Each governor 305 is secured to pivot pin 310 by a cotter key 320. The governors 305 are configured to extend radially outwardly by rotation of the drive shaft 20. The pivot pins 310 are oriented such that the governors extend radially outwardly in a plane perpendicular to the longitudinal axis of the shaft 20. Preferably, the governors are oriented to extend and retract in a common plane that is perpendicular to the axis of the drive shaft 20, but the pivot pins 310 could be offset relative to the axis of the drive shaft such that the governors extend in different but substantially parallel planes. When the drive shaft 20 and shaft sleeve 300 are not rotating, each of the governors 305 are in a first or unextended state, as depicted in FIG. 4. In contrast, when the drive shaft 20 and shaft sleeve 300 are rotating at or above a threshold RPM (revolutions per minute), each of the governors 305 rotate about a respective pivot pin 310 and extend radially outwardly to a second or extended state. With increased drive shaft RPM above the threshold RPM, each of the governors 305 may rotate further about respective pivot pin 310. The threshold RPM is selectable and the weight, size and shape of the governors is also selectable. For example, one means for adjusting the threshold RPM at which the governors move to a second or extended state is to vary the weight and/or shape of the governors. As also shown in FIG. 4, the governors 305 may optionally be provided with pre-defined score lines 325 to facilitate removal of a portion of the governor, thereby reducing its length and weight and altering its response to the RPM of the drive shaft. The governor weights 305 may be readily accessible and adjustable by removal of the pivot pin cotter keys 320. Once removed, the size, shape and/or weight of a governor 305 may be adjusted by cutting and removing weight from the governor, for example, along the scoring lines 325. It should be appreciated that the governors 305 may be removed without disassembly of the pump 10. Thus, the sealing performance of the cartridge sealing device 100 may be adjusted in the field to achieve selected centrifugal pump performance or drive shaft 20 power requirements.

Further details of one embodiment of the centrifugal pump cartridge seal 100 are provided in FIGS. 5A-D, 6 and 7. Generally, the cartridge seal 100 prevents fluid entering centrifugal pump 10 at slurry input 30 (see FIGS. 2 and 3) from migrating past the impeller 40 and around drive shaft 20 toward the pump motor. As previously noted, shaft sleeve 300 is positioned on drive shaft and is secured to the drive shaft 20 such that it rotates in unison with the drive shaft 20. A movable sleeve seal 400 is positioned around shaft sleeve 300 and moves axially relative to the shaft sleeve 300 and drive shaft 20. The proximal end 405 of the movable seal 400 includes a plurality of cutouts 410 equally spaced about the circumference of the movable seal 400. As better seen in FIG. 7, the shaft sleeve 300 comprises a plurality of apertures 330 which, when aligned with the cutouts 410, permit the shaft sleeve 300 to be secured to the drive shaft 20 by set screws 415, and also secure the movable seal 400 to rotate with the shaft sleeve 300.

Figure 5A:
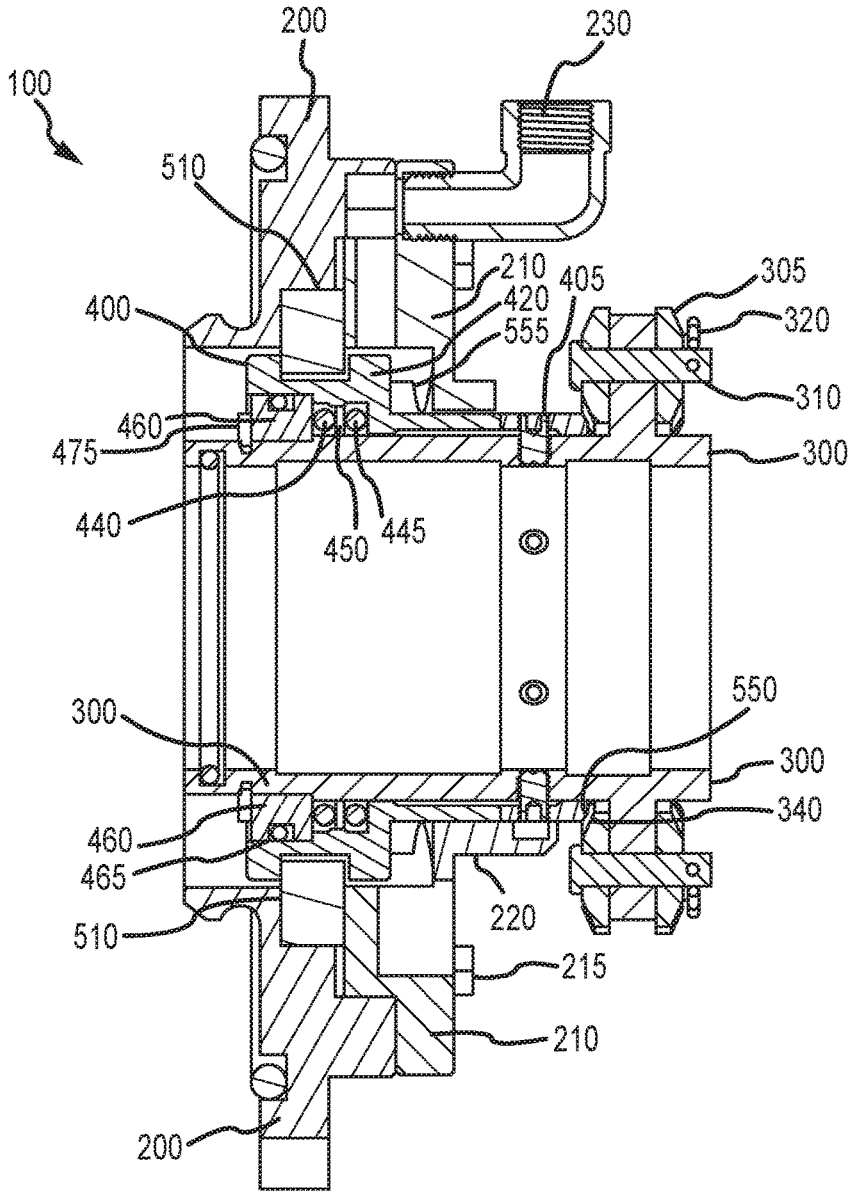
FIG. 5A is a cross-sectional elevation view of the centrifugal pump cartridge seal of FIG. 4 in a first state, taken along line 5-5 of FIG. 4.
Figure 5B:
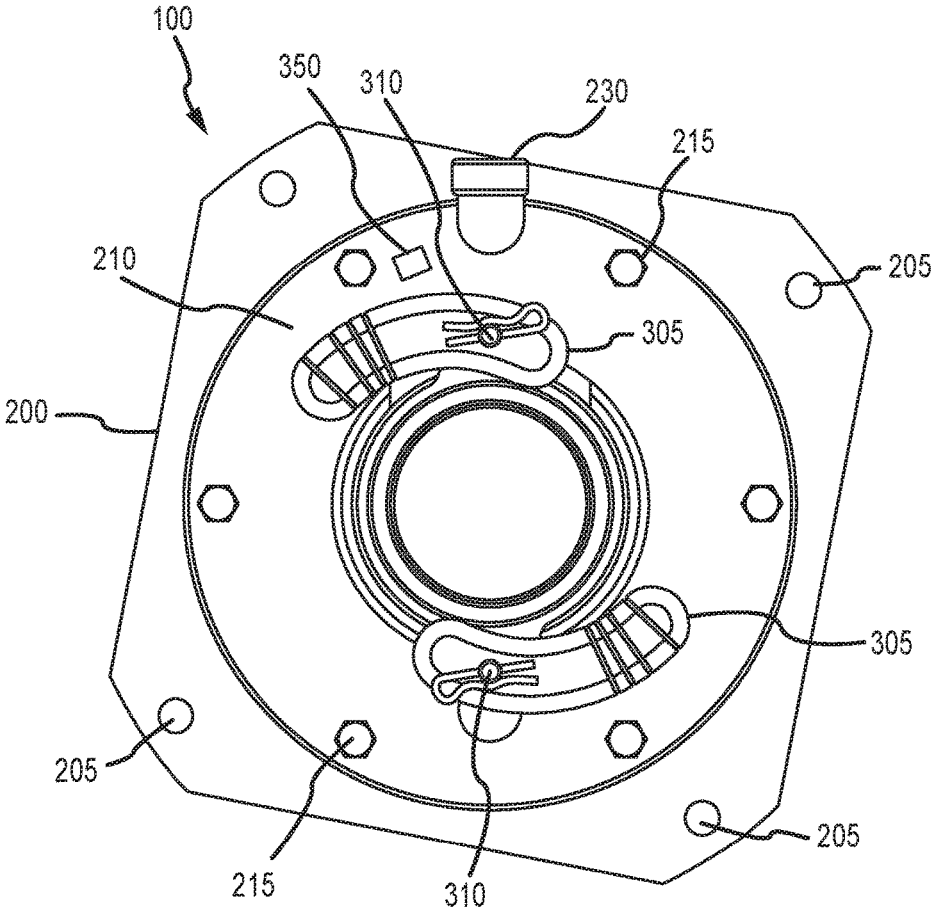
FIG. 5B is an elevation view of the distal end of the centrifugal pump cartridge seal device of FIG. 5A.
Figure 5C:
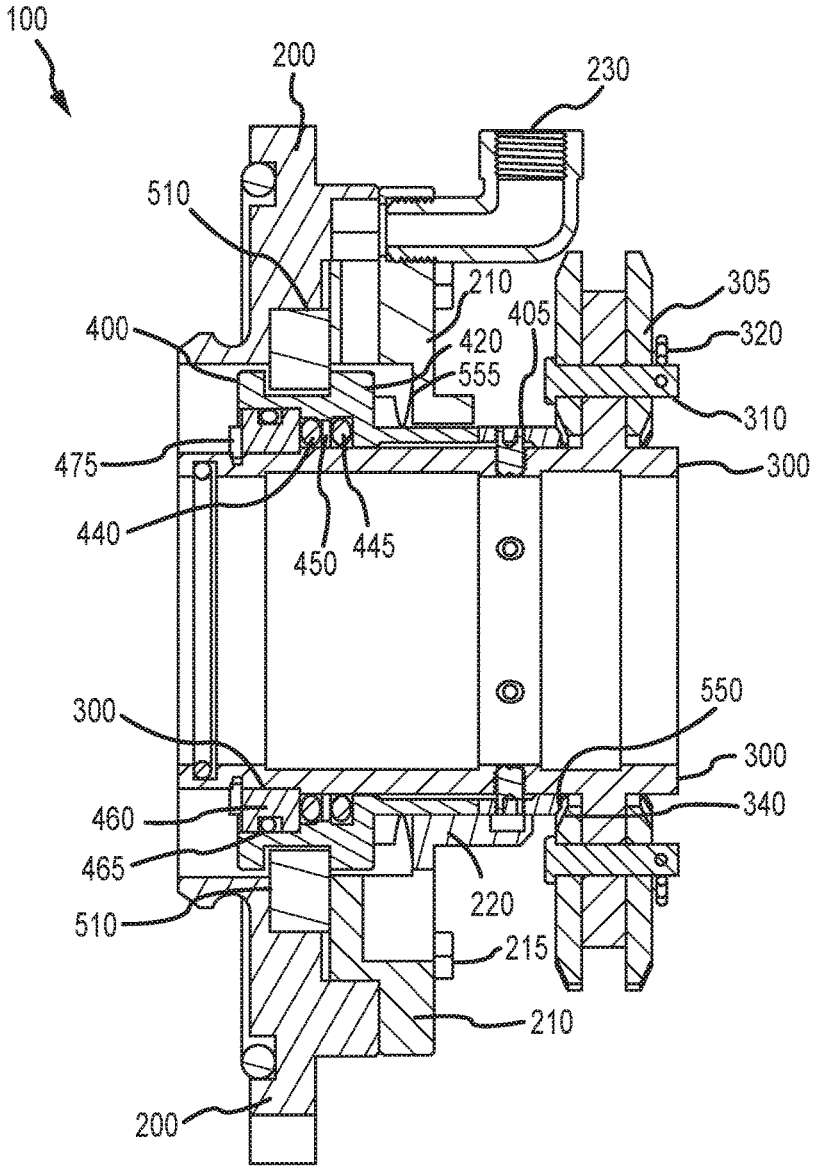
FIG. 5C is a cross-sectional elevation view of the centrifugal pump cartridge seal device of FIG. 4 in a second state, taken along line 5-5 of FIG. 4.
Figure 7:
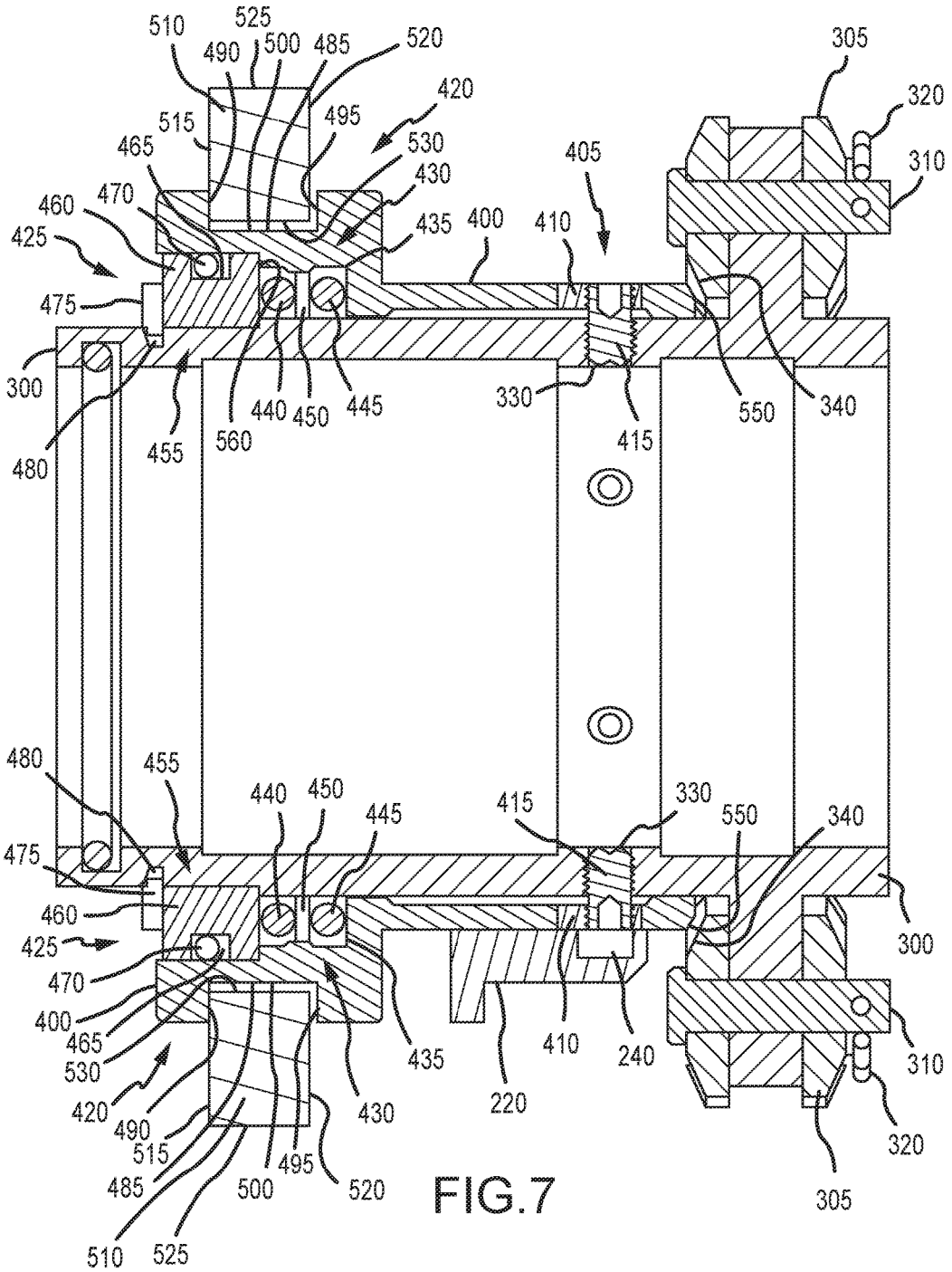
FIG. 7 is a cross-sectional elevation view of the cartridge seal with the mounting plate and closing plate removed for illustrative purposes.

With reference to FIGS. 5A, 5C and 7, the distal end 420 of movable sleeve seal 400 is spaced from the shaft sleeve 300 forming a gap 425 between the outer surface of the shaft sleeve 300 and the inner surface of the distal end 420 of the movable sleeve seal 400. In the illustrated embodiment, the gap 425 has two sections of differing heights. The proximal end 430 of the gap 425 extends from a shoulder 435 formed by the movable seal 400. A pair of axially aligned O-rings 440 and 445 are positioned in the proximal portion 430 of the gap 425 and are separated by a separation ring 450. The O-rings 440 and 445 provide a seal between the inner surface of the movable sleeve seal 400 and the outer surface of the shaft sleeve 300. The separation ring 450 maintains the axial spacing and alignment of the O-rings 440 and 445. The distal end 455 of the gap 425 has a greater height than the proximal end 430 of the gap 425. A channel sleeve 460 is positioned in the distal portion 455 of the gap 425. The channel sleeve 460 fits snugly on the outer surface of the distal end of the shaft sleeve 300 and is provided with a circumferential groove 465 on its outer surface. An O-ring 470 fits in the groove 465 and forms a seal between the channel sleeve 460 and the inner surface of the movable sleeve seal 400. The channel sleeve 460, O-rings 440 and 445, and separation ring 450 are held in axial alignment along the distal end of the shaft sleeve 300 by snap ring 475, which is friction fit in a groove 480 formed in the shaft sleeve 300.

A radially outwardly facing channel 485 is formed on the outer surface of the distal end 420 of the movable sleeve seal 400. The channel forms a first sealing surface 490, a second sealing surface 495 spaced apart from the first sealing surface 490 and a third sealing surface 500 interconnecting the first and second sealing surfaces. As shown in FIGS. 5A and 5C, the channel 485 receives the inner portion of a stationary disk seal 510. The stationary disk seal 510 comprises a distal surface 515, a proximal surface 520, an outer surface 525 and an inner surface 530. The stationary disk seal 510 is positioned such that the distal surface 515 and outer surface 525 abut a shoulder 225 formed in the mounting plate 200 and creates a fluid seal at that location. The radially-inner portion of stationary disk seal 510, comprising the inner surface 530 and portions of the distal surface 515 and proximal surface 520, is positioned to engage the first, second and third sealing surfaces 490, 495 and 500 of the movable sleeve seal 400. More specifically, distal surface 515 engages the first sealing surface 490 and third sealing surface 500 of the movable sleeve seal when the pump is static or operating below the predetermined threshold RPM, and engages a second sealing surface 495 and third sealing surface 500 when the governors 305 are in a second (extended) state. In one embodiment, the stationary disk seal 510 may be a rubber seal, and may be manufactured using a lathe.

Figure 5D:
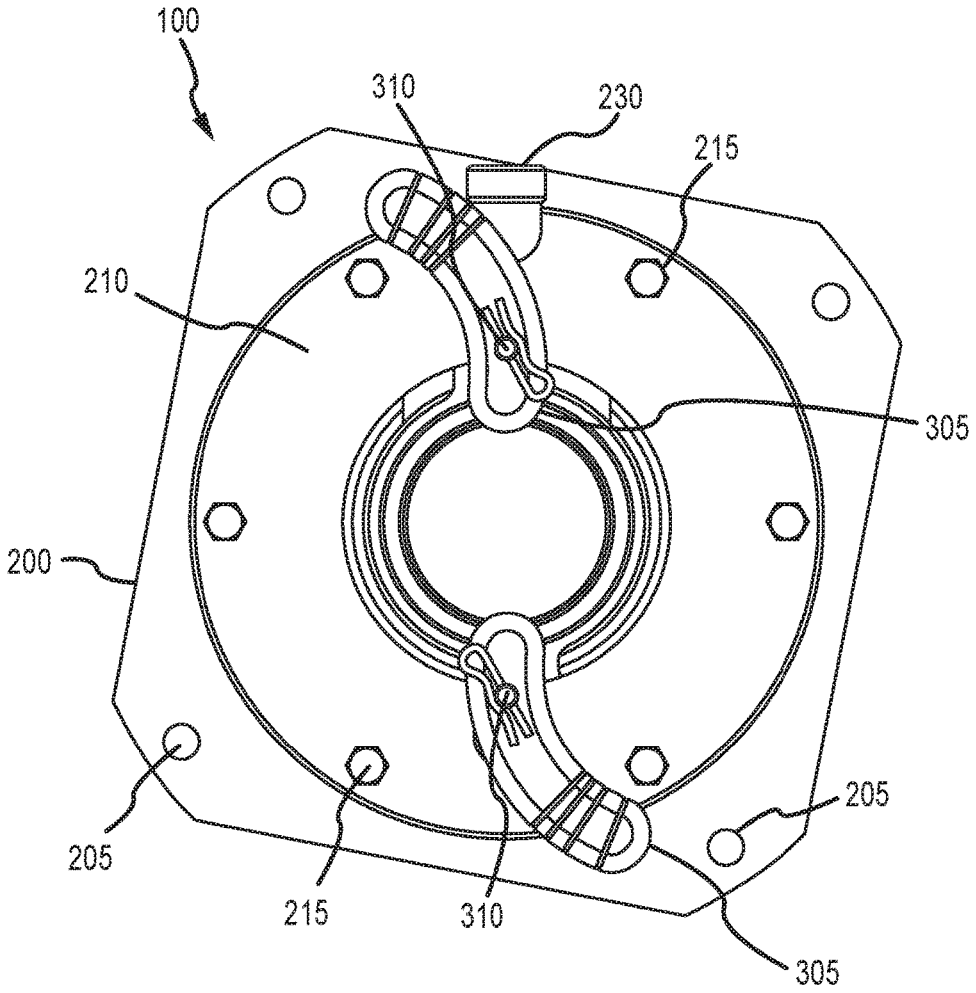
FIG. 5D is an elevation view of the distal end of the centrifugal pump cartridge seal device of FIG. 5C.
Figure 6:
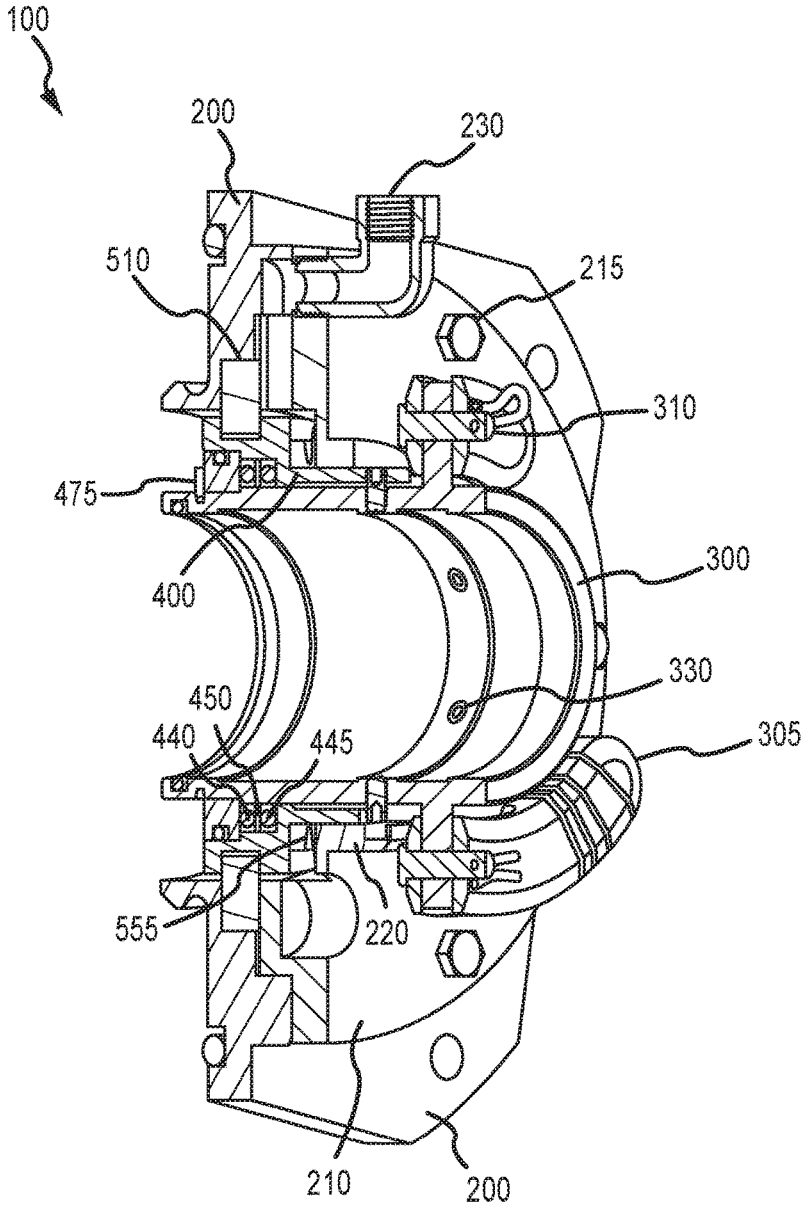
FIG. 6 is a cross-sectional perspective view of the centrifugal pump cartridge seal device of FIG. 4.

FIGS. 5A-B and 7 depict the cartridge seal 100 in a first state with governors 305 not extended, and in a second state with governors 305 extended in FIGS. 5C-D. The first state occurs when the drive shaft is not rotating or rotating at an RPM below the activation threshold RPM discussed herein. The second state occurs when the drive shaft is operating at an RPM above the threshold RPM. Governors 305 enable a tighter or increased seal for the centrifugal pump by displacing the movable seal 400 toward the pump wet end, i.e. distally to the left in FIGS. 5A-D, 6 and 7. One end of each governor 305 is configured with an actuating surface 340 which is in contact with a camming surface 550 on the movable sleeve seal 400. As drive shaft RPM increases, centrifugal forces cause governors 305 to radially extend such that actuating surface 340 distally displaces movable sleeve seal 400 toward the pump wet end, by way of the movable sleeve seal camming surface 550. The movement of the movable sleeve seal 400 forward the distal end of the seal 100 increases the sealing capabilities of the cartridge seal 100 in several ways. When displaced axially toward the wet end, the second sealing surface 495 engages the proximal end 520 of stationary disk seal 510, thereby creating a new seal. The sealing pressure increases with increased RPM. If fluid escapes, a secondary path is provided to allow exiting of the slurry by way of leak elbow 230. In addition, a flexible V-ring 555 is positioned between a proximal face 520 of the disk seal 510 and the closing plate 210. The V-ring 555 is a pressurized lip seal and functions as a secondary seal. The profile or shape of the camming surfaces and/or actuating surfaces may be varied to alter movement of the movable seal 400.

The operation of the movable sleeve seal as displaced by the governors 305 is apparent by a comparison of FIGS. 5A-B with FIGS. 5C-D. It should be appreciated that these figures are for illustrative purposes and the relative position of the component structures of the pump can and will vary depending upon actual implementation. In FIG. 5D, the centrifugal pump is operating at sufficient RPM so as to exceed the threshold RPM required to extend the governors 305 relative to shaft sleeve 300. In contrast, in FIG. 5B the centrifugal pump is either not operating or operating at insufficient RPM so as to extend the governors 305 relative to shaft sleeve 300. In FIG. 5C, the companion figure to FIG. 5D in which the governors 305 are extended, the actuating surface 340 of the governor 305 has displaced movable sleeve seal 400, by way of the camming surface 550, toward the pump wet end resulting in contact (and thus a seal) between the second sealing surface 495 and stationary disk seal proximal surface 520 and third sealing surface 500 and the inner surface 530 of the disk seal 510. The axial movement of the moveable sleeve seal 400 is limited by the proximal interior corner 560 of sleeve seal against snap ring 475 via channel sleeve 460. This limits the axial force generated by the governor 305 to prevent deteriorative thermal stress on the stationary sleeve 520. In contrast, in FIG. 5A, the companion figure to FIG. 5B in which the governors 305 are not extended, the actuating surface 340 has not displaced movable sleeve seal 400 toward the pump wet end, and thus there is no contact between the second sealing surface 495 and stationary disk seal proximal surface 520. However, a seal does exist between the first sealing surface 490 and the distal surface 515 of the disk seal 510 and the third sealing surface 500 and the inner surface 530 of the disk seal 510. Thus, the movable sleeve seal 400 provides dual seal capability; it provides a seal when the pump is at rest or at slower speed and provides a dynamic seal when the pump is at higher speed.

In addition, when displaced axially toward the wet end, the distal O-ring 440 and proximal spring O-ring 445 function as a compression spring in addition to a seal. With increased drive shaft 20 rotational speed, the distal O-ring 440 and proximal O-ring 445 are compressed between the channel sleeve 460 and the shoulder 435. When the drive shaft 20 slows such that the governors 305 are no longer applying a force on the movable sleeve seal 400 or are applying a reduced force, the distal O-ring 440 and proximal O-ring 445 expand, providing a return force on the movable sleeve 400 in the proximal direction, thereby assisting movement of the movable sleeve seal 400 to its static or first position. The separation ring 450, together with the shape of the proximal section 430 of the gap 425, maintain the linear position of the distal spring O-ring 440 relative to the proximal spring O-ring 445 such that they behave consistently and remain in the same position during repeated compression cycles. If these O-rings were able to reorient relative to each other, inconsistent compression could result. In one embodiment, the separation ring 450 is made of hard rubber and provides approximately 80 to 100 pounds per square inch of force. The use of the O-rings 440 and 445 is preferable over conventional coil springs because the gap may collect fluid slurry, potentially compromising the long term viability of a conventional spring. Additionally, a conventional spring would require a greater axial length than the O-rings, thereby increasing the axial length of the cartridge seal and the footprint of the overall pump. Similarly, O-rings are preferred over Bellville disc springs given the reduced axial length provided by O-rings.

The shape and radially-extending configuration of the governors 305 provide a number of advantages over existing governors used in centrifugal pump applications. Existing governors extend axially, such as the Waters device discussed above. Such axially-extending governor arms require more axial space than radially-extending governors, and may present a lengthy pinch-point along the drive shaft axis. In addition, they require a longer drive shaft 20 which increases the length and footprint of the pump 10 and bearing assembly 60. In contrast, the radially-extending governors 305 disclosed here require less axial space and thus a shorter drive shaft, which yields several benefits. A shorter drive shaft is less costly and lighter, produces less vibration and noise, and can operate more efficiently for a given RPM or fluid viscosity. Further, a shorter and thus relatively more rigid drive shaft will reduce seal wear and friction, thereby extending the operational life of the pump and extending maintenance intervals. In addition, the radially-extending governors 305 disclosed may be more aerodynamic than conventional axially-extending governors, thereby providing energy savings in operating the drive shaft 20. Further still, radially extending governors are safer in operation compared to governors of the type used in Waters. An object inadvertently placed in the path of the governors 305 will cause deflection of the governors about pivot points 260. The governors disclosed in Waters will not deflect and will likely break and/or be damaged and/or cause damage to the pump.

The governors 305 of FIGS. 3-7 have a height extending radially from the cylindrical shaft sleeve and a length extending along a circumference of the cylindrical shaft sleeve, wherein the length is generally of an arcuate shape. In some embodiments, other shapes are provided, e.g. a generally arcuate shape on the upper surface and most of the lower surface, yet a reduced profile away from the rotation pin point. Such a shape would allow increased rotation of a governor in that any lower surface contact of the governor with the shaft sleeve 300 would be prevented.

As shown in FIGS. 5A-D, 6 and 7, centrifugal pump cartridge seal 100 is secured to drive shaft 20 (not shown) through a plurality of set screws 415. Each set screw 415 fits through a cutout 410 in the movable shaft seal 400 and into a corresponding set screw aperture 330 in the shaft sleeve 300. As a result, the set screws 415 secure the shaft sleeve 300 to the drive shaft 20 and simultaneously accommodate axial movement of the movable sleeve seal 400. The collar 220 extends to cover the set screws 415 and includes a groove 240 to accommodate the heads of the set screws 415 as they rotate with the drive shaft 20. The collar 220 includes an open portion 250 to access the set screws for purpose of installation and subsequent adjustment and maintenance. The method of attaching the cartridge seal 100 to the drive shaft 20 is superior to the use of conventional lock tabs shown in FIG. 1. Lock tabs provide a pre-load to the seal necessary for installation purposes, but which must be removed for operation of the pump. Failure to remove the lock tabs can damage the seal and/or the pump if the pump is operated with the lock tabs in place. When maintenance or adjustment of the pump and/or seal is subsequently required, the lock tabs must be located and reinstalled. Because of their small size, the lock tabs are easily misplaced, resulting in frustration and unnecessary pump down-time. If the lock tabs cannot be located, servicing of the pump and/or seal is inhibited. In contrast, with the structure of embodiment of the present invention, the set screws may apply a preload to the cartridge seal, but also remain in place throughout operation of the pump. The access opening 250 allows an operator access to the set screws 415. The set screws may be accessed and tightened or loosened and the drive shaft 20 and shaft sleeve 300 rotated without the need for conventional lock tabs. This structure and equivalents of it, may be applied to any cartridge seal for a variety of pumps, not just centrifugal pumps. This means and configuration of securing the centrifugal pump cartridge seal 100 to the drive shaft 20 of a centrifugal pump 10 enables an easy and predicable method of installing and maintaining the centrifugal pump cartridge seal 100, as described below with reference to FIG. 9.

Figure 9:
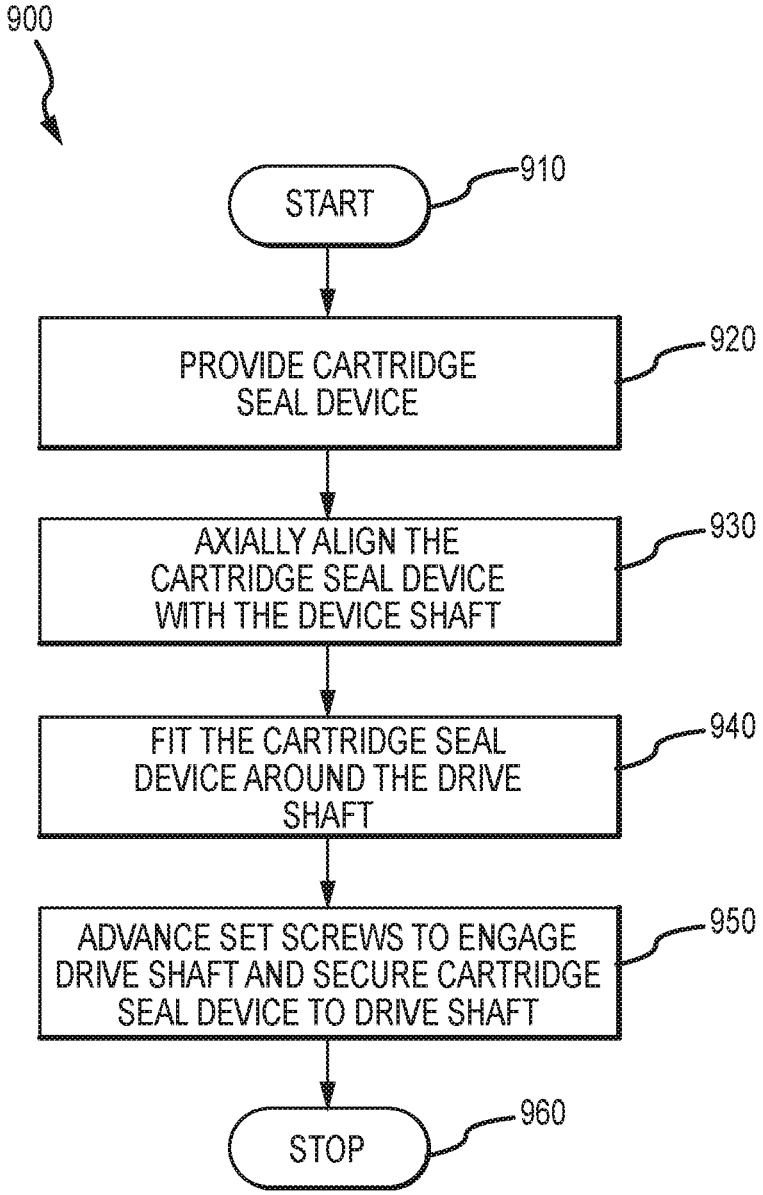
FIG. 9 is a flow-chart of a method of attaching a cartridge seal of one embodiment of the present invention to a centrifugal pump.

FIG. 9 is a flow-chart of a method of attaching the centrifugal pump cartridge seal device 100 of FIG. 2 to a centrifugal pump without the use of lock tabs. The method 900 of attaching the cartridge seal to a centrifugal pump begins with step 910. At step 920, a cartridge seal 100, as described above, is provided in a pre-assembled state. At step 930, the cartridge seal 100 is axially aligned with and fitted to the drive shaft 20. That is, the shaft sleeve 300 is axially aligned with and slid over the drive shaft 20. Next, the apertures 330 of the shaft sleeve 300 and the cutouts 410 of the movable seal 400 are aligned and axially positioned with respect to the drive shaft such that set screws 415 may engage the drive shaft 20 at user-desired locations. At step 940, the mounting plate 200 of the centrifugal pump cartridge seal device 100 is secured to the pump housing 70 by mounting bolts positioned through apertures 205. At step 950, the set screws 415 are advanced through the cutouts 410 and into a corresponding shaft sleeve set screw aperture 330 to secure the cartridge seal device 100 to the drive shaft 20. The method ends at step 960. This method 900 provides an easy and predicable method of installing and maintaining the centrifugal pump cartridge seal device 100 without the use of lock tabs. The set screws 415 may be accessed and adjusted, and the drive shaft 20 and/or shaft sleeve 300 rotated, without the need for problematic lock tabs of conventional devices. The method may be reversed to remove the centrifugal pump cartridge seal device 100 from the centrifugal pump 10.

Figure 8:
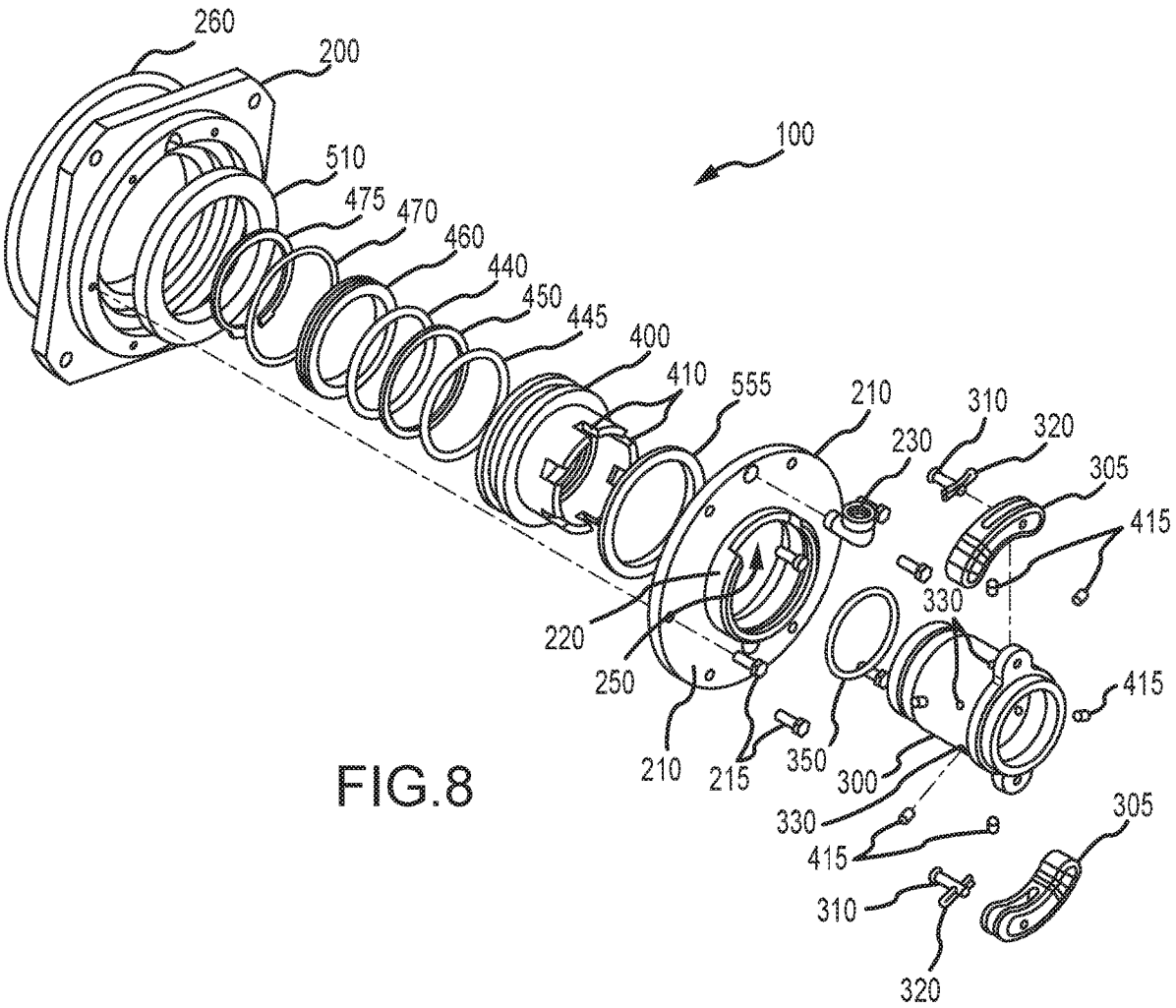
FIG. 8 is an exploded perspective view of the centrifugal pump cartridge seal device of FIG. 4.

FIG. 8 is an exploded perspective view of the centrifugal pump cartridge seal device 100. Mounting plate O-ring 260 attaches distally to mounting plate 200. In series, from the distal-most element to the most proximal, the following elements are assembled to fit within and/or engage the mounting plate 200: stationary seal 510, snap ring 475, channel sleeve 460 with channel sleeve O-ring 470, the series of distal O-ring 440, separation ring 450 and proximal O-ring 445 fitted at proximal end of movable sleeve seal 400, and V-ring 555 also fitted at proximal end of movable sleeve seal 400. Moveable sleeve seal cutouts 410 are depicted at the proximal end 405 of movable sleeve seal 400. The movable sleeve seal cutouts 410 allow set screws 415 to secure movable seal 400 relative to shaft sleeve 300 and drive shaft 20. Closing plate 210 attaches to mounting plate 200 by mounting screws 215. A leak elbow 230 fits to closing plate 200 to direct any errant fluid that may leak through the centrifugal pump cartridge seal device 100. Shaft seal 350 attaches to the inner radial surface of shaft sleeve 300 to seal shaft sleeve 300 to the drive shaft 20 (not shown). Finally, each of two governors 305 attach to shaft sleeve 300 by way of pivot pin 310 and pivot pin cotter key 320.

In one embodiment of the invention, the device is fitted with one or more active and/or passive sensors for qualitative and/or quantitative sensing of mechanical, electrical, physical, and/or chemical quantities, to detect, for example, position of the governors and/or the movable seals. Such sensors can be selected in particular from the group of temperature sensors, motion sensors, elongation sensors, rotation speed sensors, proximity sensors, flow sensors, vibration sensors, pressure sensors, conductivity sensors, acoustic pressure sensors, "lab on a chip" sensors, force sensors, acceleration sensors, tilt sensors, pH sensors, moisture sensors, magnetic field sensors, RFID sensors, magnetic field sensors, Hall sensors, biochips, odor sensors, and/or MEMS sensors. In one embodiment, the sensors are conveyed as control signals to a control unit. An example of a translation sensor 350 is shown in FIG. 5C.

While various embodiment of the present disclosure have been described in detail, it is apparent that modifications and alterations of those embodiments will occur to those skilled in the art. For example, more than two governors may be utilized to move the movable seal 400 and the slopes of the actuating and camming surfaces may be configured to achieve dynamic sealing as each individual scenario demands. It is to be expressly understood that such modifications and alterations are within the scope and spirit of the present disclosure, as set forth in the following claims.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the disclosure.

Moreover, though the present disclosure has included description of one or more embodiments and certain variations and modifications, other variations and modifications are within the scope of the disclosure, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A centrifugal pump cartridge seal device, comprising:

a cylindrical shaft sleeve having a distal end, a proximal end, an exterior, and an interior, the cylindrical shaft sleeve adapted to axially interconnect to a pump drive shaft;

a plurality of governors positioned about the exterior of the proximal end of the cylindrical shaft sleeve, each governor configured to extend outwardly in a substantially common plane with drive shaft rotation;

a movable seal with a distal end and a proximal end, the proximal end of the movable seal operatively associated with a respective surface of each governor, the distal end of the movable seal positioned distally of each respective governor and radially outward of the cylindrical shaft sleeve and forming a radially outwardly facing channel, the channel providing a first and second sealing surface;

a disk seal disposed radially outward of the movable seal and circumferentially around the channel in the distal end of the movable seal;

wherein when the drive shaft is at rest the movable seal is at a first position and the first sealing surface engages a distal surface of the disk seal and creates a fluid seal, and wherein when the drive shaft is at a rotational speed each of the plurality of governors extends to displace the movable seal to a second position and the second sealing surface engages a proximal surface of the disk seal and creates a fluid seal.

2. The device of claim 1, wherein each of the plurality of governors are pivotally attached to the cylindrical shaft sleeve to allow each governor to radially extend when the drive shaft is at a rotational speed.

3. The device of claim 1, wherein each of the plurality of governors has a generally arcuate shaped length, and when the drive shaft is at rest, the plurality of governors extending around a generally common circumference of the cylindrical shaft sleeve.

4. The device of claim 1, wherein the cylindrical shaft sleeve comprises a plurality of apertures formed about the circumference of the cylindrical shaft sleeve, each aperture adapted to receive a set screw.

5. The device of claim 4, further comprising a closing plate with an aperture formed therein and adapted to receive the cylindrical shaft sleeve, a collar extending axially from the closing plate, the collar having a radially inwardly facing surface with a groove formed therein, the collar surrounding less than the entire circumference of the cylindrical shaft sleeve and the groove circumferentially aligned with the apertures in the cylindrical shaft sleeve.

6. The device of claim 1, wherein a portion of the distal end of the movable seal is spaced from the cylindrical shaft sleeve to define a gap between the distal end of the movable seal and the distal end of the cylindrical shaft sleeve, the gap having a proximal end and a distal end, and further comprising at least one O-ring positioned axially around the cylindrical shaft sleeve and within the gap, wherein the at least one O-ring is compressed when the movable seal is in the second position.

7. The device of claim 6, wherein the at least one O-ring comprises two O-rings positioned axially proximate each other and further comprising a separation ring disposed between the two O-rings.

8. The device of claim 6, further comprising a channel sleeve positioned within the distal portion of the gap and is disposed around the distal end of the cylindrical shaft sleeve.

9. The device of claim 1, wherein the first and second sealing surfaces are substantially parallel and spaced apart from each other.

10. The device of claim 9, wherein the first sealing surface is located distally of the second sealing surface.

11. The device of claim 1, wherein the movable seal further comprises a sensor to sense at least one of translation, stress and strain.

12. The device of claim 1, wherein the respective surface of each governor comprises an actuating surface and the proximal end of the movable seal comprises at least one camming surface, and wherein each actuating surface engages the at least one camming surface to cause the movable seal to move to the second position.

13. The device of claim 12, wherein the at least one camming surface comprises a separate camming surface associated with each actuating surface.

14. In a centrifugal pump cartridge seal device having a cylindrical shaft sleeve adapted to surround a pump drive shaft, and a seal positioned radially outward of the cylindrical shaft sleeve, and where the seal moves between a first position when the pump drive shaft is at rest and a second position when the pump drive shaft is operating at speed, the improvement comprising:

a plurality of arcuately shaped governors pivotally connected to the exterior of the cylindrical shaft sleeve and aligned along a common circumference of the cylindrical shaft sleeve when the pump is at rest, and, during the drive shaft rotation, the plurality of governors are configured to extend radially away from the cylindrical shaft sleeve in a direction perpendicular to an axis of the pump drive shaft, in a plane substantially perpendicular to the axis of the pump drive shaft.

15. The device of claim 14, wherein the movable seal has a proximal end and a distal end, and wherein the proximal end engages the cylindrical shaft sleeve and a gap is formed between the distal end of the movable seal and the cylindrical shaft sleeve, further comprising at least one O-ring disposed within the gap and surrounding the cylindrical shaft sleeve, wherein the at least one O-ring is compressed when the movable seal moves to the second position and decompresses to assist movement of the movable seal to the first position as rotation of the cylindrical shaft sleeve decreases.

16. The device of claim 15, wherein the at least one O-ring comprises two O-rings positioned axially proximate each other and further comprising a separation ring disposed between the two O-rings.

17. The centrifugal pump cartridge seal device of claim 14, wherein each of the governors move between a first position and a second position and the first position and second position of each governor is in a common plane.

18. The centrifugal pump cartridge seal device of claim 14, wherein each of the plurality of governors comprise at least one scored line to facilitate removing weight from the governors.

19. The centrifugal pump cartridge seal device of claim 14, wherein the seal has a proximal end, the proximal end of the seal operatively associated with a respective surface of each arcuately shaped governor, wherein the respective surface of changed to at least one of the plurality of arcuately shaped governors comprises an actuating surface and the proximal end of the seal comprises at least one camming surface, and wherein each actuating surface engages the at least one camming surface to cause the movable seal to move to the second position.

20. The centrifugal pump cartridge seal device of claim 14, further comprising an annular disk disposed radially outward of and circumferentially around the seal, wherein when the pump is at rest, the annular disk engages a first portion of the seal, and when the plurality of governors are extended, the annular disk engages a second portion of the seal.

21. A method for attaching a cartridge seal device to a pump, comprising the steps of:

providing a cartridge seal device comprising:

a cylindrical shaft sleeve having a distal end, a proximal end, an exterior, and an interior, and having a plurality of apertures spaced about the circumference of the exterior to receive set screws to interconnect the cartridge seal device to a pump drive shaft;

a mounting plate having a central aperture and a collar, the collar extending axially outwardly proximate the perimeter of the central aperture and having a radially inwardly facing surface with a groove formed in the surface;

a movable seal having an exterior surface and a plurality of slots aligned around the exterior;

positioning the mounting plate and cylindrical shaft sleeve around the pump drive shaft such that the cylindrical shaft sleeve is positioned in the central aperture of the mounting plate and positioning the movable seal around the exterior of the cylindrical shaft sleeve;

aligning the mounting plate relative to the cylindrical shaft sleeve such that the groove in the collar is radially aligned with the apertures in the exterior of the cylindrical shaft sleeve and aligning the slots in the movable seal with the apertures in the cylindrical shaft sleeve;

advancing a plurality of set screws in the apertures formed in the cylindrical shaft sleeve to engage the drive shaft; and, securing the mounting plate to the pump.

22. A centrifugal pump cartridge seal device, comprising:

a cylindrical shaft sleeve having a distal end, a proximal end, an exterior, and an interior, the cylindrical shaft sleeve adapted to axially interconnect to a pump drive shaft;

a plurality of governors positioned about the exterior of the proximal end of the cylindrical shaft sleeve, each governor configured to extend outwardly in a substantially common plane with drive shaft rotation, and at least one score line formed in each governor to facilitate removing weight from each governor;

a movable seal with a distal end and a proximal end, the proximal end of the movable seal operatively associated with a respective surface of each governor, the distal end of the movable seal positioned distally of each respective governor and radially outward of the cylindrical shaft sleeve and providing a first and second sealing surface;

wherein when the drive shaft is at rest the movable seal is at a first position and the first sealing surface creates a fluid seal with respect to the fluid pressure, and wherein when the drive shaft is at a rotational speed each of the plurality of governors extend to displace the movable seal to a second position and the second sealing surface creates a fluid seal.

* * * * *